United States Patent [19]

Sweeton

[11] 4,021,042

[45] May 3, 1977

[54] MAGNETIC BOARD GAME

[75] Inventor: Gerard F. Sweeton, Skillman, N.J.

[73] Assignee: Vivitronics Corporation, Princeton Junction, N.J.

[22] Filed: Oct. 28, 1975

[21] Appl. No.: 620,484

[52] U.S. Cl. ..... 273/131 AD; 273/1 M; 273/136 B; 273/137 AE

[51] Int. Cl.[2] ..... A63F 3/00

[58] Field of Search ..... 273/1, 130, 131, 134, 273/135, 136, 153

[56] References Cited

UNITED STATES PATENTS

| | | | |
|---|---|---|---|
| 2,339,209 | 1/1944 | Vensel | 273/1 M UX |
| 2,819,904 | 1/1958 | Nelson et al. | 273/130 A |
| 3,537,576 | 11/1970 | Macaluso | 273/87.2 X |
| 3,625,514 | 12/1971 | Haaland | 273/95 R |
| 3,734,502 | 5/1973 | Bolton | 273/95 R |

*Primary Examiner*—Delbert B. Lowe
*Attorney, Agent, or Firm*—Sperry and Zoda

[57] ABSTRACT

A board game having a board with an array of pockets or recesses in the upper surface thereof including magnetic bases located within the game board below each of the pockets, each magnetic base having a randomly selected magnetic polarity, the game including a plurality of round, magnetic playing pieces adapted to be placed in the pockets and having oppositely colored sides of opposite polarity, said pieces adapted to align themselves with either colored side oriented upward responsive to the particular polarity of the particular pocket in which located.

5 Claims, 11 Drawing Figures

MAGNETIC BOARD GAME

BACKGROUND OF THE INVENTION

1. Field of Invention

The present invention relates to a wide class of board-type games in which playing pieces are sequentially moved from a starting location to a designated final location. The object of this class of games is to be the first to have all of one's pieces reach this final location. Chinese type checkers is particularly exemplary of this class of games. A well known variant of this class of games is checkers wherein the object is to capture an opponent's pieces rather than reach a designated location.

Games such as the above are defined by the sequential movement of pieces along predefined rows and columns within the game board array. The positioning of one's pieces can be utilized to block opponent's movements as well as to be intermediate steps in the transporting of one's own pieces from the starting position to the final position.

2. Description of the Prior Art

The use of magnets, magnetized playing pieces or magnetic game board surfaces is old in the art throughout a great variety of types of games. Examples of such games are shown in U.S. Pat. Nos. 3,765,679 and 2,819,904 issued to O'Connell and Nelson et al, respectively. These games illustrate game apparatus configurations which utilize magnetic polarity to introduce a chance element into the game which would not otherwise be possible. The use of magnetic force as a game element also adds a dynamic physical aspect to the game which would not otherwise be possible. Magnetized surfaces are also often used in game surfaces to facilitate contact between the playing surface and the playing pieces themselves. In this respect such games as chess and checkers are often played with playing pieces being magnetized and with a playing surface capable of reacting thereto. For example, in chess the attachment between the playing pieces and the desired playing location at any particular time can be facilitated by magnetization of the playing piece and the playing surface. In this way there is less chance of the playing piece being dislodged from its designated point. A similar advantage is apparent in other games in this class such as checkers.

The prior art does not show any game configuration where the magnetic force is utilized as a dynamic aspect of the game such that the playing pieces themselves are substantially altered dependent upon the location of placement. This dynamic game concept is one of several important aspects considered in the present invention.

SUMMARY OF THE INVENTION

The present invention includes a substantially flat horizontal playing surface which has positioned upon the upper surface thereof an array of possible playing piece locations, such as pockets or the like. The configuration of the pockets may be chosen as any desired formation in conformity with the desired rules of play. Each pocket has associated therewith a magnetic base which gives each pocket a predefined magnetic polarity. This magnetic polarity is chosen randomly for each particular pocket and as such introduces the desired element of chance into the game. The playing pieces for use in the present invention are formed as magnetized steel balls or as generally round playing pieces having a magnetic device implanted therein. In this respect, all playing pieces will have a predefined magnetic polarity. The playing pieces may be chosen with different coloration on each hemisphere. Under the rules of some games the surface coloration may serve to define the magnetic polarity associated with that hemisphere of the playing piece. Under other rules coloration will be random. The shape of the playing pieces and the shape of the pockets can be chosen from a variety of configurations such that whenever a playing piece is placed into a pocket having a polarity similar to the side of the playing piece which is placed adjacent the bottom of the pocket, then the playing piece will be repelled and will invert itself such that a pole of "attraction" will be adjacent the base of the pocket. Each player will be designated as the Black or White player and as such when pieces are moved by a player into a position whereby the playing piece itself is inverted then the playing piece will revert to become one belonging to the opponent. This aspect of the game is applicable to many types of such games including chinese checkers and the like.

It is an object of the present invention to provide a game board with playing pieces positioned thereon adapted to automatically invert responsive to certain predetermined conditions It is an object of the present invention to provide a game board having a plurality of magnetic devices embedded therein in a random order to introduce an element of chance into the game.

It is an object of the present invention to provide a game board which is adapted to repel one side of magnetic playing pieces and to attract the opposite side of magnetic playing pieces.

It is an object of the present invention to provide a game which fully integrates the elements of chance and the factor of skill.

It is an object of the present invention to provide a table-top magnetized board game apparatus which has associated therewith an aspect of dynamic movement provided by magnetic forces.

BRIEF DESCRIPTION OF THE DRAWINGS

While the invention is particularly pointed out and distinctly claimed in the concluding portions herein, the preferred embodiments are set forth in the following detailed description which may be best understood when read in connection with the accompanying drawings, in which:

DETAILED DESCRIPTION OF THE PREFERRED EMBODIMENT

Figure 3:
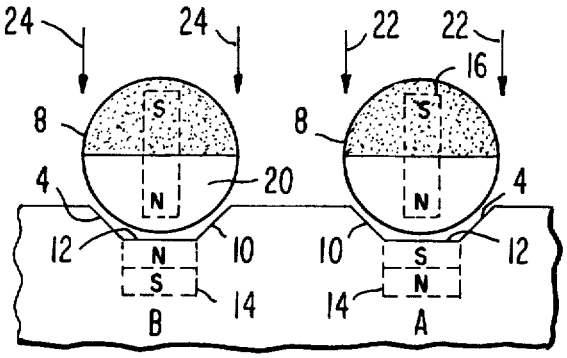
FIG. 3 is a sectional view of two pockets of a game board used in the present invention with playing pieces being inserted therein.
Figure 6:
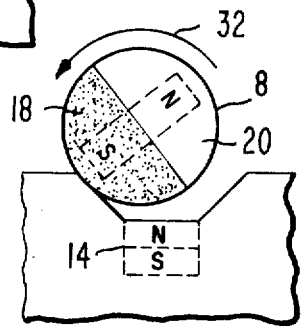
Figure 7:
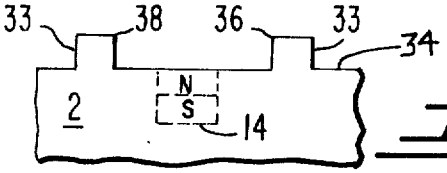
FIG. 7 shows a front sectional view of another embodiment of the pockets of the present invention.
Figure 8:
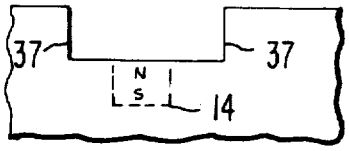
FIG. 8 illustrates a front sectional view of still another embodiment of the pockets of the present invention.
Figure 9:
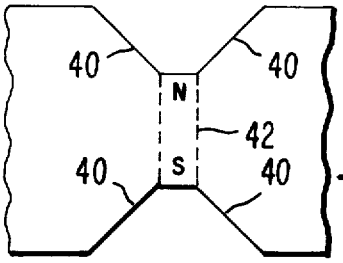
FIG. 9 illustrates a side sectional view of still another embodiment with both sides of the game board having the pockets of the present invention.

An embodiment of the present invention includes a game board 2 which has included in the upper portion thereof a plurality of pockets or recesses designated generally as 4. The array can be chosen with a configuration of any desired form such as a square, rectangle or the like. In this embodiment, each pocket 4 has associated therewith a magnetic base 14 adjacent the lower surface of said pocket. The magnetic bases 14 are positioned sufficiently proximate to the bottom of pockets 4 such that any magnetic device placed within the pocket will react with base 14. Two playing pieces 8 are shown in FIG. 3 in the process of being placed within pockets 4. The pockets shown in FIGS. 3, 4, 5, and 6 are formed with inclined planes 10 which terminate in a floor section 12 which is formed by the upper surface of magnetic bases 14. These pockets can also have other alternative configurations such as shown in FIGS. 7, 8, and 9 and also the playing pieces can have other shapes or can have spherical shapes such as the embodiments shown in FIGS. 10 and 11.

Games utilizing the above apparatus will generally be played by the placement of playing pieces 8 within pockets 4 for initial setup. Subsequent thereto, playing pieces 8 will be moved into pockets which are adjacent to its present pocket such that the entire set of one player's pieces will move from an initial location to a final location. In this respect, the player who moves all his pieces to a final location first will be the winner. These general rule systems will allow for a variety of particular games to be played with the game board and playing piece structure of this embodiment of the present invention.

One important aspect of the present invention includes the magnetic interaction between the magnetic bases 14 and the magnetic playing pieces 8. The playing pieces 8 can be magnetized steel balls or can have embedded therein a magnetic device such as magnet 16 shown embedded within playing piece 8 in FIG. 3. The magnetized playing piece 8 is thereby divided into two hemispheres having opposite polarity. To facilitate play, these hemispheres may be colored differently such as shown as Black hemisphere 18 and White hemisphere 20.

Figure 4:
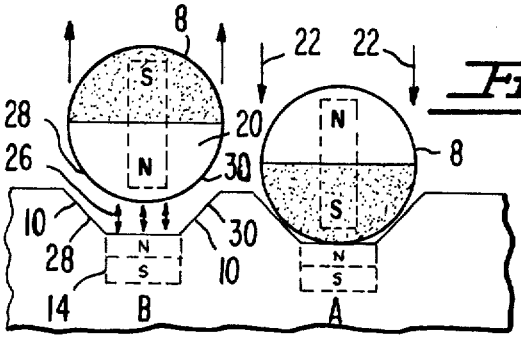
FIG. 4 illustrates the apparatus shown in FIG. 3, with the respective playing pieces being both repelled and attracted.

The orientation of magnetic bases 14 within the array of pockets 4 is chosen randomly such that each pocket has a predetermined polarity. Also the relationship between polarity and hemisphere coloration can be chosen randomly. In this respect, the playing pieces 8 will be attracted or repelled by a particular pocket 4 dependent upon the relationship between the polarity of the pocket and the polarity of the surface of the playing piece which faces downwardly. The interaction between the playing piece 8 and the pocket 4 when their adjacent sides are of different polarity is shown in the "A" sections of FIGS. 3 and 4. As playing piece 8 is placed downwardly as shown by the arrows 22, the opposite poles will attract. In this manner, the playing piece 8 will be firmly held in position in pocket 4 as shown in FIG. 4, section A.

On the other hand, if the polarity of the pocket 4 is similar to the polarity of the adjacent side of the playing piece, then the magnetic forces will repel. The interaction which thereby follows is illustrated by sections B of FIGS. 3 and 4 and the action shown in FIGS. 5 and 6. The player will initially release the playing piece 8 at a height slightly above the top surface of playing board 2 and the playing piece 8 will start to fall downwardly into the pocket 4 as shown in the B section of FIG. 3. This movement is shown by arrows 24. As the playing piece 8 moves downwardly, it will exert force by its adjacent opposing pole against the similar pole of the magnetic base 14. As shown, in FIGS. 3 and 4, the pocket can be chosen with a North, or White, polarity and the playing piece is being placed in the pocket with, for example the North, or White, hemisphere pointed downwardly and the Black, or South, section pointed upwardly. Only as the playing piece 8 becomes very close to the pocket 4 will the forces start to interact strongly due to the fact that magnetic forces are strongly dependent upon the distance between the force sources. As the playing piece 8 starts to settle within pocket 4, the repelling forces between the White hemisphere 20 and the magnetic base 14 will increase rapidly such that a repelling force between the pocket 4 and the playing piece 8 will be created along force lines generally shown as 26. The closer the surface of White hemisphere 20 comes to base area 12, the greater will be the magnetic repulsive forces therebetween. These repelling magnetic forces will prohibit playing piece 8 from settling firmly within the pocket 4. Even if the weight of the playing piece is such that it overcomes much of the magnetic repelling force, the pressure between the playing piece and the pocket will be extremely low such that rotation of the playing piece can be made easily. Even if the playing piece is allowed to settle within the pocket, it will only contact the inclined walls 10 of the pocket at two intermediate points 28 and 30. Since the only possible contact between the pocket and the playing piece will be at two points, this will again minimize friction therebetween and facilitate rotation of the playing pieces in response to the repelling magnetic forces.

Figure 5:
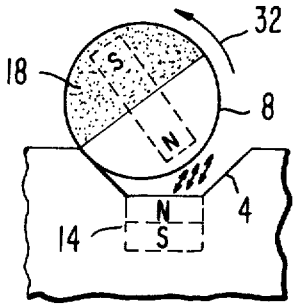
FIG. 5 and FIG. 6 illustrate the repelled playing piece of FIG. 4 during the process of inversion.

Since the friction between the contacting surfaces of playing piece 8 and pocket 4 is minimized, the repelling forces will cause the playing piece 8 to tilt in one direction as shown in FIG. 5. Once a slight tilting is created, the repelling force between magnetic base 14 and White hemisphere 20 will be supplemented by the slight but increasing attractive force between magnetic base 14 and Black southern pole 18. As playing piece 8 tilts further, the attractive force between Black hemisphere 18 and magnetic base 14 increases. This attractive force will further cause the playing piece 8 to rotate in a counterclockwise direction as shown by arrow 32. As White hemisphere 20 rotates further from repelling magnetic base 14, the repelling forces therebetween decrease; however, similarly, the attracting forces between Black southern pole 18 and magnetic base 14 increase. In this manner, the playing piece 8 is allowed to fully rotate to the final settling position shown in FIG. 4A. Rotation as shown in FIGS. 5 and 6 is facilitated by the fact that the contact area between the playing piece 8 and the pocket 4 is minimized due to the chosen configuration of each structure. In the embodiment shown in FIG. 4A, there will only be two points of contact between the playing piece and the pocket. In other embodiments such as where the pocket is of a hemispherical cross-section, there will only be one contact point between the playing piece and the pocket. In any of these chosen configurations, the repelling force between the like poles of the playing piece and the magnetic base will cause the frictional forces exerted at the contact points to be minimized such that rotation in the direction shown by arrow 32 is facilitated. In this embodiment, we see a magnetic game board and playing piece construction which will automatically rotate the playing piece in response to certain game conditions. In particular, a playing piece which undergoes the rotational movement shown in FIGS. 4, 5, and 6 will dynamically and suddenly belong to the opposing player. It should be appreciated that polarity can be assigned to each similarly colored hemisphere of each playing piece in a random fashion.

Various alternative configurations for the pocket configurations are available depending upon ease and cost of manufacture. In particular, a flat horizontal board surface 34 can have pockets formed therein by having vertically extending protrusions 33 extending upward therefrom along at least some portions of the borders defining the pockets. With this configuration, the magnetic base 14 can be positioned in the center of the designated pocket area and the pointed edges 36 and 38 will provide the two points of contact between the playing piece 8 and the pocket 8 such that rotational movement due to repelling magnetic forces between the playing piece 8 and the pocket 4 is made easier. Another possible structure is shown in FIG. 8 as a recessed rectangular or square segment formed by vertically extending walls 37 which lead to the flat horizontal base area.

FIG. 9 illustrates another possible alternative configuration using vertically inclined walls 40 extending inwardly from both sides of the game board 2 to form pockets on the upper and lower sides thereof. In this manner, a magnetic base 42 can form the base structure of both corresponding pockets on both the upper and lower surfaces. In this manner, simplification of construction and cost savings are achieved. In addition, another full board configuration is provided by this configuration on the bottom surface which is a mirror-image of the array pattern on the upper surface. In this manner, the possibility of memorization of the array polarity is minimized.

Figure 10:
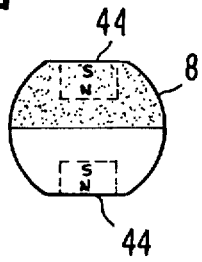
FIG. 10 and FIG. 11 illustrate alternative embodiments for the configuration of the playing pieces of the present invention.
Figure 11:
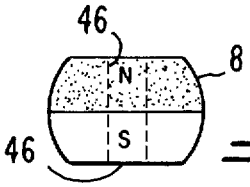

The playing pieces can have a generally spherical structure. If desired, the areas adjacent to each respective pole can be truncated into a flat section to increase magnetic interaction between the poles of the playing piece and the magnetic base 14. One embodiment is shown in FIG. 10 where a magnet is placed in each opposite colored side of playing piece 8 such as to form flat truncated sections 44 immediately adjacent to the strongest point of each pole. In this respect, the magnetic base 14 will realize greater magnetic attraction or repulsion with respect to the two magnetic poles associated with playing piece 8. Another structure is shown in FIG. 11 utilizing a single magnet where the north pole is associated with the Black hemisphere and the south pole is associated with the White hemisphere. In this construction, only one magnetic device need be implanted within a playing piece 8.

Figure 1:
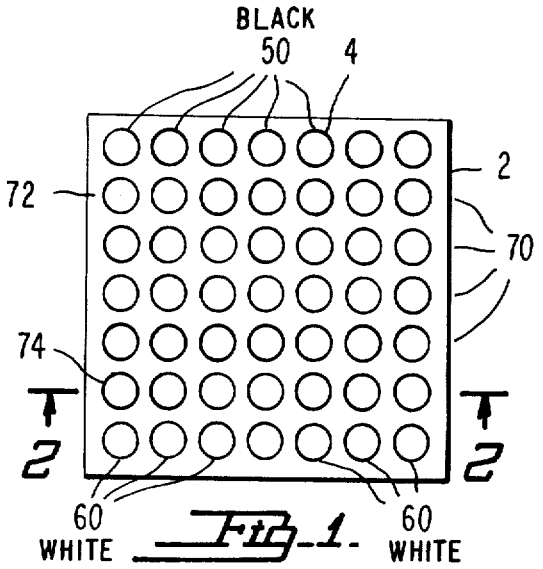
FIG. 1 is a top plan view of the game board of an embodiment of the present invention.
Figure 2:
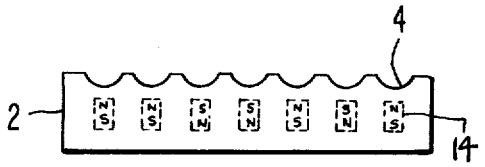
FIG. 2 is a front sectional view of the embodiment shown in FIG. 1 along lines 2—2.

In the play of one of the many possible games, two rows of pockets are chosen on opposite sides of the board such as shown in FIG. 1 as row of pockets 50 and row of pockets 60. In this example, the pockets 50 and 60 will all be chosen with only a steel device embedded under the pocket such that playing pieces can be placed in these starting pockets with either polar orientation. In this manner, the White player places pieces in his seven starting pockets with the White hemisphere facing upwardly. Similarly when the Black player places seven playing pieces in pockets 50, they will all be oriented with their Black hemisphere facing upward. Thus, we see that a rule of the game will be that the White player owns all pieces having the White hemisphere oriented upwardly. Similarly, the Black player owns all playing pieces having the Black hemisphere oriented upwardly.

The rows of pockets 70 intermediate between rows 50 and 60 of pockets are chosen with randomly selected polarity. The object of the game is for one player to move all his pieces to the initial row of his opponent's starting pieces. In this example, the White player must move seven playing pieces into row 50. Each player will constantly be losing or regaining pieces as he moves his pieces into pockets having the wrong polarity and as his opponent keeps moving pieces into pockets having the wrong polarity. For example, if the White player moves a piece having its White hemisphere facing upwardly from pockets 60 into one of the pockets in row 74 and the particular pocket which he chooses has the wrong polarity, then the playing piece will rotate to show the Black surface upwardly as has been previously described in FIGS. 4, 5, and 6. When this event occurs, the piece will now belong to his opponent and it is the opponent who now proceeds to move this particular piece. It should be appreciated that a great variety of game rule combinations can be chosen for this game apparatus but it is the dynamic and sudden winning and losing of pieces which introduces the elements of both chance and memory of pocket polarity as important factors in the play of the game.

While particular embodiments of this invention have been shown in the drawings and described above, it will be apparent that many changes may be made in the form, arrangement and positioning in the various elements of the combination. In consideration thereof, it should be understood that preferred embodiments of this invention disclosed therein are intended to be illustrative only and not intended to limit the scope of the invention.

I claim:

1. A magnetic board game comprising:

a. a game board defining a plurality of pockets arranged in an array formation thereon;

b. a plurality of magnetic bases located adjacent said pockets and positioned within said game board, said magnetic bases giving each pocket a predefined magnetic polarity; and c. a plurality of spherical magnetic playing pieces including a first side and a second side of oppositely defined polarity, said playing pieces adapted to be selectively positioned within said pockets.

2. The game as defined in claim 1 wherein said first and second sides of said playing pieces are oppositely colored with respect to one another to define polarity thereof.

3. The game as defined in claim 1 wherein each of said sides of said playing pieces includes a flat truncated section.

4. The game as defined in claim 1 wherein said pockets are in the form of arcuate depressions in the substantially flat upper surface of said game board.

5. The game as defined in claim 1 wherein said pockets include flat inclined walls and a horizontal flat floor section.

* * * * *